US010563148B2

(12) United States Patent
Shinoda et al.

(10) Patent No.: US 10,563,148 B2
(45) Date of Patent: Feb. 18, 2020

(54) LUBRICANT OIL COMPOSITION

(71) Applicant: IDEMITSU KOSAN CO., LTD, Chiyoda-ku (JP)

(72) Inventors: Jitsuo Shinoda, Ichihara (JP); Shinji Aoki, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/779,486

(22) PCT Filed: Feb. 10, 2014

(86) PCT No.: PCT/JP2014/053029
§ 371 (c)(1),
(2) Date: Sep. 23, 2015

(87) PCT Pub. No.: WO2014/156338
PCT Pub. Date: Oct. 2, 2014

(65) Prior Publication Data

US 2016/0032214 A1 Feb. 4, 2016

(30) Foreign Application Priority Data

Mar. 29, 2013 (JP) ..... 2013-074689

(51) Int. Cl.
*C10M 161/00* (2006.01)
*C10M 169/04* (2006.01)

(52) U.S. Cl.
CPC ..... *C10M 161/00* (2013.01); *C10M 169/044* (2013.01); *C10M 2203/1025* (2013.01); *C10M 2205/022* (2013.01); *C10M 2209/084* (2013.01); *C10M 2209/103* (2013.01); *C10M 2215/064* (2013.01); *C10M 2215/086* (2013.01); *C10M 2215/223* (2013.01); *C10M 2215/28* (2013.01); *C10M 2223/04* (2013.01); *C10M 2223/041* (2013.01); *C10M 2223/043* (2013.01); *C10M 2229/02* (2013.01)

(58) Field of Classification Search
CPC ..... C10M 161/00; C10M 169/044; C10M 2223/045; C10M 2215/28; C10M 2215/064; C10M 2229/02; C10M 2223/041; C10M 2209/103; C10M 2223/043; C10M 2203/1025; C10M 2215/086; C10M 2209/084; C10M 2205/022; C10M 2223/04; C10M 2215/223; C10M 2207/289; C10M 2207/026; C10M 2205/024; C10N 2230/04; C10N 2230/43; C10N 2240/08; C10N 2230/42; C10N 2230/68; C10N 2220/021; C10N 2220/022
See application file for complete search history.

(56) References Cited

U.S. PATENT DOCUMENTS

| | | | | |
|---|---|---|---|---|
| 6,756,346 | B1 | 6/2004 | Baba et al. | |
| 2004/0053794 | A1 | 3/2004 | Baba | |
| 2006/0135378 | A1* | 6/2006 | Takahashi | C10M 169/04 508/433 |
| 2008/0058235 | A1* | 3/2008 | Takigawa | C10M 169/04 508/564 |

FOREIGN PATENT DOCUMENTS

| | | | |
|---|---|---|---|
| CN | 1938408 | | 3/2007 |
| CN | 101517054 | | 8/2009 |
| CN | 101945983 | | 1/2011 |
| EP | 1 529 830 | A1 | 5/2005 |
| EP | 1 734 103 | A1 | 12/2006 |
| EP | 2 248 879 | A1 | 11/2010 |
| JP | 2000-63866 | A | 9/2000 |
| JP | 2002-265971 | A | 9/2002 |
| JP | 2003-171684 | A | 6/2003 |
| JP | 2005-307197 | A | 11/2005 |
| JP | 2005-307202 | A | 11/2005 |
| JP | 2008-13679 | A | 1/2008 |
| JP | 2009-144045 | A | 7/2009 |

(Continued)

OTHER PUBLICATIONS

International Search Report dated Apr. 1, 2014 in PCT/JP2014/053029 filed Feb. 10, 2014.

(Continued)

*Primary Examiner* — Taiwo Oladapo

(74) *Attorney, Agent, or Firm* — Oblon, McClelland, Maier & Neustadt, L.L.P.

(57) ABSTRACT

A lubricating oil composition contains: a base oil with a kinematic viscosity at 40 degrees C. in a range from 1 $mm^2/s$ to 200 $mm^2/s$, a viscosity index of 80 or more and a sulfur content of less than 0.03 mass %; a component (A) being a polyacrylate compound with a mass average molecular weight in a range from 10,000 to 100,000; and a component (B) being at least one of phosphorus compounds represented by a formula (1) below. A content of the component (B) is in a range from 0.05 mass % to 2.0 mass % of a total amount of the composition, and a viscosity index of the composition is 160 or more.

(1)

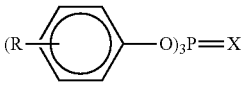

8 Claims, No Drawings

(56) References Cited

FOREIGN PATENT DOCUMENTS

| | | | |
|---|---|---|---|
| JP | 2009-161664 | A | 7/2009 |
| KR | 10-2011-0059308 | A | 6/2011 |
| WO | 2008/038571 | A1 | 4/2008 |
| WO | WO 2009/040658 | A1 | 4/2009 |
| WO | 2010/064347 | A1 | 6/2010 |
| WO | WO 2011/101348 | A1 | 8/2011 |

OTHER PUBLICATIONS

Extended European Search Report dated Sep. 20, 2016 in Patent Application No. 14773785.2.
Chinese Office Action dated Mar. 21, 2017 in connection with corresponding Chinese Patent Application No. 201480016928, filed Feb. 10, 2014.
Australian Office Action dated Feb. 26, 2018 in Patent Application No. 2014245378, 6 pages.
Office Action dated Nov. 28, 2018 in corresponding Australian Patent Application No. 2018201517, 2 pages.
Office Action dated Dec. 26, 2018 in Indian Patent Application No. 3591/KOLNP/2015 with English translation.

* cited by examiner

LUBRICANT OIL COMPOSITION

CROSS-REFERENCE TO RELATED APPLICATIONS

This application is a National Stage of PCT/JP2014/053029, which was filed on Feb. 10, 2014. This application is based upon and claims the benefit of priority to Japanese Application No. 2013-074689, which was filed on Mar. 29, 2013.

TECHNICAL FIELD

The present invention relates to a lubricating oil composition and, in particular, to a lubricating oil composition for a hydraulic oil for construction machines, a hydraulic oil for industrial machines, a hydraulic oil for windmills, a hydraulic oil for machine tools, a turbine oil, a compressor oil, an oil agent for shock absorbers, and the like.

BACKGROUND ART

In order to meet the requirements of reducing emissions of exhaust gas and carbon dioxide according to the environmental regulations or the like, hardware modifications have been made on industrial machines and construction machines to employ motorization, an electricity storage system using a regenerative energy, or the like.

Further, in order to meet a demand for an essential technique for improving the properties of a hydraulic oil used in a hydraulic system to achieve a high efficiency, fuel-saving and power-saving hydraulic oils are disclosed (see, for instance, Patent Literature 1).

Since a pressure in hydraulic equipment has become increasingly high from year to year, troubles such as scoring of a hydraulic pump are frequently caused. Accordingly, the ISO standard has employed an FZG scoring test. A typical method for improving an FZG scoring resistance is adding an acid phosphate or an amine salt thereof or an active sulfur compound (see, for instance, Patent Literature 2).

CITATION LIST

Patent Literature

Patent Document 1: WO 2008/038571
Patent Literature 2: JP-A-2003-171684

SUMMARY OF THE INVENTION

Problems to be Solved by the Invention

For hydraulic equipment, an increase in a pressure is accompanied by an increase in an oil temperature, so that sludge formed from additives has become a problem. The sludge causes the clogging of a filter, the spool lock of a switching valve, and the wear of a pump. The compositions disclosed in Patent Literatures 1 and 2, however, are unlikely to meet all the demands for wear resistance, low-sludge properties and excellent fuel-economy performance.

An object of the invention is to provide a lubricating oil composition that restrains formation of sludge and is excellent in wear resistance such as scoring resistance and in fuel-economy performance.

Means for Solving the Problems

In order to solve the above problems, an aspect of the invention provides the following lubricating oil composition.

[1] A lubricating oil composition contains: a base oil with a kinematic viscosity at 40 degrees C. in a range from 1 $mm^2/s$ to 200 $mm^2/s$, a viscosity index of 80 or more and a sulfur content of less than 0.03 mass %; a component (A) being a polyacrylate compound with a mass average molecular weight in a range from 10,000 to 100,000; and a component (B) being at least one of phosphorus compounds represented by a formula (1) below.

Formula 1

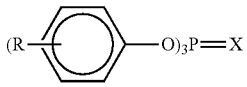

(1)

In the formula, R is a hydrogen atom or an alkyl group having 4 or less carbon atoms, and X is an oxygen atom or a sulfur atom.

A content of the component (B) is in a range from 0.05 mass % to 2.0 mass % of a total amount of the composition, and a viscosity index of the composition is 160 or more.

[2] In the lubricating oil composition, the content of the component (B) is in a range from 0.1 mass % to 1.0 mass % of the total amount of the composition.

[3] The lubricating oil composition further contains a component (C) being at least one of sulfur compounds represented by a formula (2) below.

Formula 2

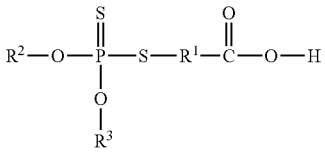

(2)

In the formula, $R^1$ represents a linear or branched alkylene group having 1 to 8 carbon atoms, and $R^2$ and $R^3$ each represent a hydrocarbon group having 3 to 20 carbon atoms.

[4] A lubricating oil composition contains: a base oil with a kinematic viscosity at 40 degrees C. in a range from 1 $mm^2/s$ to 200 $mm^2/s$, a viscosity index of 80 or more and a sulfur content of less than 0.03 mass %; a component (A) being a polyacrylate compound with a mass average molecular weight in a range from 10,000 to 100,000; and a component (B) being at least one of phosphorus compounds represented by a formula (1) below.

Formula 3

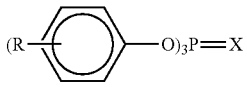

(1)

In the formula, R is a hydrogen atom or an alkyl group having 4 or less carbon atoms, and X is an oxygen atom or a sulfur atom.

The lubricating oil composition also contains a component (C) being at least one of sulfur compounds represented by a formula (2) below.

Formula 4

(2)

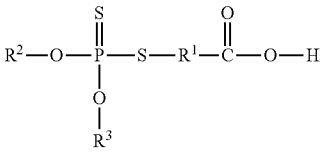

In the formula, $R^1$ represents a linear or branched alkylene group having 1 to 8 carbon atoms, and $R^2$ and $R^3$ each represent a hydrocarbon group having 3 to 20 carbon atoms.

A viscosity index of the composition is 160 or more.

[5] The lubricating oil composition further contains: either or both of a component (D) being an amine salt compound prepared with a phosphate represented by a formula (3) below and a component (E) being a sulfur compound represented by a formula (4) below.

Formula 5

(3)

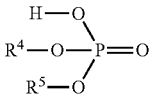

In the formula, $R^4$ is a hydrogen atom or a hydrocarbon group having 1 to 18 carbon atoms, and $R^5$ are each independently a hydrocarbon group having 1 to 18 carbon atoms.

Formula 6

(4)

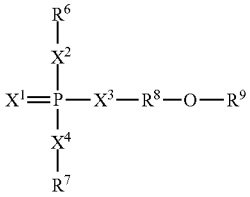

In the formula, $R^6$, $R^7$ and $R^9$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms, $R^8$ is a linear or branched alkylene group having 1 to 6 carbon atoms, $X^2$, $X^3$ and $X^4$ are each independently a divalent oxygen atom or sulfur atom, $X^1$ is an oxygen atom or a sulfur atom, and at least one sulfur atom exists in the formula (4).

[6] A hydraulic oil contains the lubricating oil composition

The above aspect(s) of the invention can provide a lubricating oil composition that restrains formation of sludge and is excellent in wear resistance such as scoring resistance and in fuel-economy performance.

DESCRIPTION OF EMBODIMENT(S)

First Exemplary Embodiment

According to a first exemplary embodiment, a lubricating oil composition contains or is provided by blending a base oil with (A) a specific polyacrylate compound and (B) a specific phosphorus compound and, preferably, also with a component (C), a component (D) or a component (E). A detailed description is as follows.

Base Oil

A base oil in the lubricating oil composition of the first exemplary embodiment (hereinafter, occasionally simply referred to as "the present composition") has a kinematic viscosity at 40 degrees C. in a range from 1 $mm^2/s$ to 200 $mm^2/s$. When the kinematic viscosity at 40 degrees C. is not less than 1 $mm^2/s$, evaporation loss is small. When the kinematic viscosity at 40 degrees C. is not more than 200 $mm^2/s$, an excessive power loss due to viscosity resistance can be avoided. More preferably, the kinematic viscosity at 40 degrees C. is in a range from 10 $mm^2/s$ to 100 $mm^2/s$.

The viscosity index of the base oil is 80 or more. When the viscosity index is 80 or more, a change in viscosity with temperature is small, so that the base oil can maintain a necessary viscosity at a high temperature. The viscosity index is more preferably 100 or more and further more preferably 120 or more. The base oil preferably has a saturated content of 90 mass % or more. When the saturated content is 90 mass % or more, the present composition exhibits an improved oxidation stability. The saturated content is more preferably 95 mass % or more and further more preferably 97 mass % or more. The base oil has a sulfur content of less than 0.03 mass %. When the sulfur content in the base oil is less than 0.03, the present composition exhibits an improved oxidation stability. Incidentally, the sulfur content is a value measured according to JIS K 2541 and the saturated content is a value measured according to ASTM D 2007.

As the base oil used in the present composition, one of base oils categorized into Group II, III or IV of the base oil categories according to American Petroleum Institute (API) or a mixture of two or more thereof is suitably usable. Base oils of Group II have a viscosity index in a range from 80 to 120, a sulfur content of 0.03 mass % or less and a saturated content of 90 mass % or more. Base oils of Group III have a viscosity index of 120 or more, a sulfur content of 0.03 mass % or less and a saturated content of 90 mass % or more. Base oils of Group IV are poly-alpha-olefin (PAO).

The base oil may be a mineral oil or a synthetic oil as long as the base oil has the above properties. The mineral oil or the synthetic oil is subject to no particular limitation in type or others. Examples of the mineral oils include paraffin-based mineral oils, intermediate-based mineral oils and naphthene-based mineral oils that are prepared by purifying processes such as solvent purification, hydrogenation purification and hydrocracking.

Examples of the synthetic oil include poly-alpha-olefin (PAO), alpha-olefin-copolymer, polybutene, alkylbenzene, polyol ester, dibasic acid ester, polyoxy alkylene glycol, polyoxy alkylene glycol ester, polyoxy alkylene glycol ether, hindered ester and silicone oil. Further, isomerized products of slack wax and GTL WAX are also usable.

Among the above examples, mineral oils prepared by hydrogenation purification, mineral oils prepared by hydrocracking, isomerized products of slack wax and GTL WAX (i.e., wax-isomerized mineral oils) and poly-alpha-olefin are favorably usable.

According to the first exemplary embodiment, one of the above mineral oils may be used alone or a combination of two or more thereof may be used as the base oil. Alternatively, one of the above synthetic oils may be used alone or a combination of two or more thereof may be used. Further alternatively, a combination of at least one of the above mineral oils and at least one of the above synthetic oils may be used.

Component (A)

The component (A) in the present composition is an acrylate compound having a mass average molecular weight in a range from 10,000 to 100,000. When the mass average molecular weight falls below the above lower limit, the fuel-economy performance is deteriorated. When the mass average molecular weight exceeds the above upper limit, the shear stability of the lubricating oil composition is lowered. The mass average molecular weight of the component (A) is preferably in a range from 15,000 to 80,000, and particularly preferably in a range from 20,000 to 75,000.

Preferable examples of the polyacrylate compound include poly(meth)acrylate compounds, among which polymethacrylate (PMA) is preferable. The polymethacrylate may be dispersed or non-dispersed.

In the present composition, one of the above polyacrylate compounds may be used alone as the component (A) or a combination of two or more thereof may be used.

The content of the component (A) is preferably in a range from 0.1 mass % to 20 mass %, more preferably in a range from 0.2 mass % to 15 mass %, of the total amount of the composition. When the content is equal to or more than the above lower limit, the component (A) has a sufficient effect in improving the viscosity index. When the content is equal to or less than the above upper limit, the shear stability and piston-cleaning performance of the lubricating oil composition are improved.

Component (B)

The phosphorus compound usable as the component (B) of the present composition is triaryl phosphate or triaryl thiophosphate represented by a formula (1) below.

Formula 7

(1)

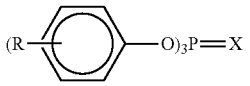

In the formula (1), R is a hydrogen atom or an alkyl group having 4 or less carbon atoms and X is an oxygen atom or a sulfur atom. In the formula (1), three R may be mutually the same or different. Examples of the alkyl group having 4 or less carbon atoms include a methyl group, ethyl group, n-propyl group, isopropyl group, n-butyl group, isobutyl group and tertiary butyl group.

The phosphorus compound represented by the formula (1) preferably has an acid number of 10 mg KOH/g or less. When the acid number is 10 mg KOH/g or less, the resulting lubricating oil composition exhibits excellent heat resistance and formation of sludge can be restrained. The acid number is more preferably 5 mg KOH/g or less and further more preferably 1 mg KOH/g or less. Incidentally, the acid number is a value measured according to JIS K 2501.

Examples of the phosphorus compound represented by the formula (1) include triphenyl phosphate, tricresyl phosphate, triphenyl thiophosphate, tricresyl thiophosphate, mono(di)-t-butyltriphenyl phosphate, and triphenyl phosphorothioate.

In the present composition, one of the above phosphorus compounds may be used alone as the component (B) or a combination of two or more thereof may be used. The content of the component (B) is in a range from 0.05 mass % to 2.0 mass % of the total amount of the composition. When the content exceeds 2.0 mass %, the component (B) is unlikely to have a large effect in providing the wear resistance. Similarly, when the content is less than 0.05 mass %, the component (B) is unlikely to have an effect in providing the wear resistance. The content is more preferably in a range from 0.1 mass % to 1.0 mass %.

Component (C)

The sulfur compound used as the component (C) in the present composition is preferably a dithiophosphate compound represented by a formula (2) below.

Formula 8

(2)

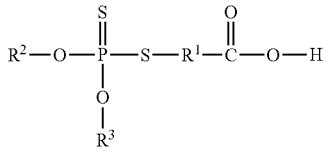

In the formula (2), $R^1$ represents a linear or branched alkylene group having 1 to 8 carbon atoms, and $R^2$ and $R^3$ each represent a hydrocarbon group having 3 to 20 carbon atoms.

In the formula (2), when the carbon number of $R^1$ is more than 8, the component (C) often fails to dissolve in the base oil. In view of the above, $R^1$ is preferably a linear or branched alkylene group having 1 to 8 carbon atoms, more preferably a linear or branched alkylene group having 2 to 4 carbon atoms, and further preferably a branched alkylene group. Specifically, $R^1$ is preferably, for instance, $—CH_2CH_2—$, $—CH_2CH(CH_3)—$, $—CH_2CH(CH_2CH_3)—$ or $—CH_2CH(CH_2CH_2CH_3)—$, and more preferably $—CH_2CH(CH_3)—$ or $—CH_2CH(CH_3)CH_2—$.

When the carbon number of each of $R^2$ and $R^3$ is less than 3 (i.e., a low molecular weight), the sulfur compound often fails to adsorb to a metal surface. When the carbon number of each of $R^2$ and $R^3$ is more than 8, the sulfur compound often fails to dissolve in the base oil. In view of the above, $R^2$ to $R^3$ each preferably represent a linear or branched alkyl group having 3 to 8 carbon atoms, and more preferably a linear or branched alkyl group having 4 to 6 carbon atoms. Specifically, $R^2$ to $R^3$ is each preferably selected from the group consisting of propyl, isopropyl, butyl, isobutyl, t-butyl, pentyl, isopentyl, hexyl, 2-ethylbutyl, 1-methylpentyl, 1,3-dimethylbutyl and 2-ethylhexyl groups, among which isobutyl and t-butyl are further preferable.

In the present composition, one of the above dithiophosphate compounds may be used alone as the component (C) or a combination of two or more thereof may be used.

The content of the component (C) is preferably in a range from 0.01 mass % to 2.0 mass %, more preferably in a range from 0.02 mass % to 0.5 mass %, of the total amount of the composition.

Component (D)

The component (D) in the present composition is preferably an amine salt compound prepared by reacting an amine compound with a phosphate represented by a formula (3) below.

Formula 9

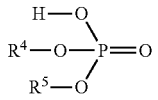

(3)

In the formula (3), $R^4$ is a hydrogen atom or a hydrocarbon group having 1 to 18 carbon atoms, and $R^5$ is a hydrocarbon group having 1 to 18 carbon atoms.

The amine compound for preparing the amine salt may be a monosubstituted amine having 4 to 60 carbon atoms, disubstituted amine having 4 to 60 carbon atoms or a trisubstituted amine having 4 to 60 carbon atoms.

Examples of the monosubstituted amine include butylamine, pentylamine, hexylamine, cyclohexylamine, octylamine, laurylamine, stearylamine, oleylamine and benzylamine. Examples of the disubstituted amine include dibutylamine, dipentylamine, dihexylamine, dicyclohexylamine, dioctylamine, dilaurylamine, distearylamine, dioleylamine and dibenzylamine. Examples of the trisubstituted amine include tributylamine, tripentylamine, trihexylamine, tricyclohexylamine, trioctylamine, trilaurylamine, tristearylamine, trioleylamine and tribenzylamine. The amine compound may also be alkanolamine, examples of which include stearyl/monoethanolamine, decyl/monoethanolamine, hexyl/monopropanolamine, benzyl/monoethanolamine, phenyl/monoethanolamine, tolyl/monopropanolamine, dioleyl/monoethanolamine, dilauryl/monopropanolamine, dioctyl/monoethanolamine, dihexyl/monopropanolamine, dibutyl/monopropanolamine, oleyl/diethanolamine, stearyl/dipropanolamine, lauryl/diethanolamine, octyl/dipropanolamine, butyl/diethanolamine, benzyl/diethanolamine, phenyl/diethanolamine, tolyl/dipropanolamine, xylyl/diethanolamine, triethanolamine and tripropanolamine.

One of the above amine compounds may be used alone or a combination of two or more thereof may be used.

Examples of the amine salt compound prepared by reacting the amine compound with the phosphate of the formula (3) include bis(1,3-dimethylbutyl)phosphate dodecylamine, bis(n-octyl)phosphate.bis(n-decanyl)phosphate dodecylamine, 2-ethylhexyl acid phosphate oleylamine and 2-ethylhexyl acid phosphate coconut amine.

In the present composition, one of the above amine salt compounds prepared by reacting the phosphate with the amine compound may be used alone as the component (D) or a combination of two or more thereof may be used.

The content of the component (D) is preferably in a range from 0.005 mass % to 0.5 mass %, more preferably in a range from 0.01 mass % to 0.1 mass %, of the total amount of the composition.

Component (E)

The sulfur compound used as the component (E) in the present composition is preferably a thiophosphate compound represented by a formula (4) below.

Formula 10

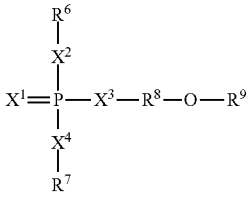

(4)

In the formula (4), $R^6$, $R^7$ and $R^9$ are each independently a linear or branched saturated or unsaturated aliphatic hydrocarbon group having 1 to 18 carbon atoms or a branched or unbranched saturated or unsaturated cyclic hydrocarbon group having 5 to 18 carbon atoms. $R^8$ is a linear or branched alkylene group having 1 to 6 carbon atoms. $X^2$, $X^3$ and $X^4$ are each independently a divalent oxygen atom or sulfur atom. $X^1$ is an oxygen atom or a sulfur atom. In the formula (4), at least one sulfur atom exists.

The above sulfur compound, which contains a sulfur atom and a phosphorus atom in a molecule, contributes to improving the wear resistance (e.g., scoring resistance). Specific examples are a thiophosphate compound and a dithiophosphate compound.

Examples of the thiophosphate compound include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, xylenyldiphenyl phosphorothionate, tris(n-propylphenyl)phosphorothionate, tris(isopropylphenyl)phosphorothionate, tris(n-butylphenyl)phosphorothionate, tris(isobutylphenyl)phosphorothionate, tris(s-butylphenyl)phosphorothionate and tris(t-butylphenyl)phosphorothionate.

Examples of the dithiophosphate compound include dihexyl dithiophosphate, dioctyl dithiophosphate, di(2-ethylhexyl) dithiophosphate, didodecyl dithiophosphate, dihexadecyl dithiophosphate, di(hexylthioethyl) dithiophosphate, di(octylthioethyl) dithiophosphate, di(dodecylthioethyl) dithiophosphate, di(hexadecylthioethyl) dithiophosphate, dioctenyl dithiophosphate, dioleyl dithiophosphate, dicyclohexyl dithiophosphate, diphenyl dithiophosphate, ditolyl dithiophosphate, dibenzyl dithiophosphate, diphenethyl dithiophosphate and ethyl-3-[{bis(1-methylethoxy) phosphinothioyl}thio ]propionate.

In terms of the effects of the invention, the dithiophosphate compound is more preferable than the thiophosphate compound.

Other Additives

Further, in order to improve the performance of the present composition, known additives such as oiliness agent, dispersant, rust inhibitor, metal deactivator, anticorrosive, antioxidant, demulsifier and antifoaming agent may be blended as needed as long as an object of the invention is achieved.

Examples of the oiliness agent include: saturated or unsaturated aliphatic monocarboxylic acids such as stearic acid and oleic acid; dimerized fatty acids such as dimer acid and hydrogenated dimer acid; hydroxy fatty acids such as ricinoleic acid and 12-hydroxystearic acid; saturated or unsaturated aliphatic monoalcohols such as lauryl alcohol and oleyl alcohol; saturated or unsaturated aliphatic monoamines such as stearylamine and oleylamine; saturated or unsaturated aliphatic monocarboxylic acid amides such as a mixture of an aliphatic secondary amine with a hydrocarbon chain having 8 to 18 carbon atoms, lauric acid amide and oleic acid amide; and multivalent fatty acid esters such as an oleic acid monoglyceride. The content of the oiliness agent is preferably in a range from 0.01 mass % to 10 mass %, more preferably in a range from 0.1 mass % to 5 mass %, of the total amount of the composition.

Examples of the dispersant include succinimide derivatives. One of the above dispersants may be used alone or a combination of two or more thereof may be used. This component contributes to preventing rust and dispersing sludge. As the succinimide derivative, a succinimide having an alkyl group or an alkenyl group in a side chain, which is known as an ashless dispersant, is favorably usable. In particular, a succinimide with a side chain that has an alkyl group or an alkenyl group and has a number average molecular weight approximately in a range from 500 to 3000 is preferable. When the number average molecular weight of the side chain is less than 500, the succinimide is likely to be less dispersible in the base oil. On the other hand, when the number average molecular weight of the side chain is more than 3000, the succinimide is difficult to handle in preparation of the lubricating oil composition. Further, the viscosity of the composition is excessively increased, so that, for instance, the composition may deteriorate the operating characteristics of hydraulic equipment or the like where the composition is used.

There are a variety of examples of the succinimide, which include a succinimide having a polybutenyl group or a polyisobutenyl group. The polybutenyl group is provided by polymerizing a mixture of 1-butene and isobutene or a highly pure isobutene or by hydrogenating a polyisobutenyl group. Incidentally, the succinimide may be either a so-called mono-alkenyl/alkyl succinimide or a so-called bis-alkenyl/alkyl succinimide.

The succinimide derivative may be further modified with boron in use. For instance, a boron-modified polybutenyl succinimide may be provided by adding an organic solvent such as alcohols, hexane and xylene with the above polyamine, a polybutenyl succinic acid (anhydride) and a boron compound such as a boric acid and heating the mixture under appropriate conditions. Incidentally, examples of the boron compound include boric anhydride, halogenated boron, borate, amide borate and boron oxide in addition to a boric acid. Among the above, a boric acid is particularly preferable.

When the boron-modified succinimide is blended, a boron content is preferably in a range from 1 mass ppm to 50 mass ppm, more preferably in a range from 5 mass ppm to 30 mass ppm, of the total amount of the composition.

In the first exemplary embodiment, the content of the dispersant is preferably in a range from 0.01 mass % to 1 mass %, more preferably in a range from 0.05 mass % to 0.5 mass %, of the total amount of the composition.

Examples of the metal deactivator and the anticorrosive include benzotriazole and thiadiazole. The content of these metal deactivators and anticorrosives is preferably approximately in a range from 0.005 mass % to 1 mass %, more preferably in a range from 0.007 mass % to 0.5 mass %, of the total amount of the composition.

Examples of the antioxidant include a phenolic antioxidant and an amine antioxidant. One of these antioxidants may be used alone or a combination of two or more thereof may be used. Examples of the phenolic antioxidant include monophenolic compounds such as 2,6-di-tert-butyl-4-methyl phenol, 2,6-di-tert-butyl-4-ethyl phenol and octadecyl 3-(3,5-di-tert-butyl-4-hydroxyphenyl)propionate and diphenolic compounds such as 4,4'-methylenebis(2,6-di-tert-butylphenol) and 2,2'-methylenebis(4-ethyl-6-tert-butylphenol).

Examples of the amine antioxidant include: monoalkyldiphenylamine compounds such as monooctyldiphenylamine and monononyldiphenylamine; dialkyl diphenylamine compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine compounds such as tetrabutyldiphenylamine, tetrahexyldiphenylamine, tetraoctyldiphenylamine and tetranonyldiphenylamine; and naphthylamine compounds such as alpha-naphthylamine, phenyl-alpha-naphthyl amine, butylphenyl-alpha-naphthylamine, pentylphenyl-alpha-naphthylamine, hexylphenyl-alpha-naphthylamine, heptylphenyl-alpha-naphthylamine, octylphenyl-alpha-naphthylamine and nonylphenyl-alpha-naphthylamine.

According to the first exemplary embodiment, one of the above phenolic antioxidants may be used alone or a combination of two or more thereof may be used. Similarly, one of the above amine antioxidants may be used alone or a combination of two or more thereof may be used. Further, one or more of the above phenolic antioxidants and one or more of the above amine antioxidants are preferably used in combination. According to the first exemplary embodiment, the content of the antioxidant is preferably in a range from 0.05 mass % to 2 mass %, more preferably in a range from 0.1 mass % to 1 mass %, of the total amount of the composition.

The demulsifier may be polyalkylene glycols and metal sulfonates, among which a polyalkylene glycol in the form of an EO/PO block copolymer (EO: ethyleneoxide, PO: propyleneoxide) having OH at both terminals is preferable. The content of the demulsifier is preferably in a range from 0.001 mass % to 1.0 mass %, more preferably in a range from 0.01 mass % to 0.5 mass %, of the total amount of the composition.

Examples of the antifoaming agent include polymeric-silicone antifoaming agents and polyacrylate antifoaming agents. The content of the antifoaming agent is preferably in a range from 0.0001 mass % to 0.5 mass %, more preferably in a range from 0.0005 mass % to 0.3 mass %, of the total amount of the composition.

Lubricating Oil Composition

The present composition prepared as described above has a viscosity index of 160 or more. When the viscosity index is less than the above lower limit, the temperature-dependency of viscosity increases, which is not preferable. Incidentally, the viscosity index may be measured according to JIS K 2283. The viscosity index is preferably 165 or more.

The present composition exhibits good heat resistance to restrain formation of sludge, and is excellent in wear resistance such as scoring resistance and in fuel-economy performance. The present composition is thus suitably usable as a hydraulic oil for construction machines, a hydraulic oil for industrial machines, a hydraulic oil for windmills, a hydraulic oil for machine tools, a turbine oil, a compressor oil, and an oil agent for shock absorbers, contributing to enhancing device efficiency. Especially, the present composition improves a flow rate per unit time, and thus is greatly effective for a device whose performance depends on a flow rate. Since exhibiting an excellent shear stability and reducing formation of sludge in use, the present composition is durable for a long-term use. Further, the present composition exhibits high extreme pressure properties, and thus is highly effective in preventing pump seizure.

Second Exemplary Embodiment

Next, description will be made on a lubricating oil composition according to a second exemplary embodiment of the invention Incidentally, description of the same arrangement(s) as that of the first exemplary embodiment will be omitted or simplified hereinbelow.

The present composition is provided by blending a base oil with (A) a specific polyacrylate compound, (B) a specific phosphorus compound and a component (C) and, preferably, also with a component (D) or a component (E). A detailed description is as follows.

Component (C)

The sulfur compound used as the component (C) in the present composition is a dithiophosphate compound represented by the above formula (2).

The content of the component (C) is preferably in a range from 0.01 mass % to 2.0 mass %, more preferably in a range from 0.02 mass % to 0.5 mass %, of the total amount of the composition.

The present composition of the second exemplary embodiment is the same as that of the first exemplary embodiment except the component (C), and thus further description of the second exemplary embodiment is omitted.

It should be noted that when a combination of the component (C) and the component (B) is employed, the content of the component (B) is preferably in a range from 0.05 mass % to 0.5 mass % of the total amount of the composition.

EXAMPLES

Next, the invention will be further described in detail based on Examples, which by no means limit the invention. Incidentally, the performance was evaluated by the following methods.

(1) Wear Resistance (FZG Scoring Resistance Test)

A load was gradually increased using an FZG gear test rig based on the conditions according to ISO 14635-1 and a load stage where scoring was caused was taken as wear resistance.

(2) Static Friction Coefficient

A static friction coefficient at 1000 cycles was measured by SAE No. 2 friction test according to "Hydraulic fluids for construction machinery—Test method for friction characteristics (JCMAS P047)" defined by the Japan Construction Machinery and Construction Association.

(3) Heat Resistance (the Amount of Sludge after an Oxidation Test)

Based on a test for determining the oxidation stability of a lubricating oil for an internal combustion engine (ISOT) according to JIS K 2514-1996, resulting sludge was collected by a millipore filter and the amount of the sludge (mg/100 mL) was measured. A test temperature was 150 degrees C. and a test time was 168 hours.

(4) High-pressure Vane Pump Test

After the steady operation of a hydraulic circuit with a vane pump (F11-SQP2-12, manufactured by TOKIMEC, Inc) for two hours under the conditions where the oil temperature is 60 degrees C., the revolution is 1200 pm and the discharge pressure is 14.0 MPa, flow rate was measured for one hour.

Incidentally, the length of a duct line consisted of: 1.2 m of a section between a pump outlet to a relief valve (inner diameter: 25.44 mm, a pressure-resistant rubber hose PA2816-77 manufactured by Bridgestone Flowtech Corporation); and 1.8 m of a suction side (inner diameter: 38.1 mm, a pressure-resistant rubber hose VW24 manufactured by Bridgestone Flowtech Corporation), a tank capacity was 100 L, and an integrating flowmeter was RSA0040A0FBMD3450010R type manufactured by NITTO SEIKO CO., LTD.

Examples 1 to 6 and Comparatives 1 and 2

As shown in Tables 1 and 2, sample oils of Examples and Comparatives were prepared by blending base oils with a variety of additives and the performance of each oil was evaluated. The results are shown in Tables 1 and 2.

TABLE 1

| | Kinematic Viscosity at 40° C. ($mm^2/s$) | Kinematic Viscosity at 100° C. ($mm^2/s$) | Viscosity Index | Mass Average Molecular Weight (Mw) | Sulfur Content (mass %) | P Content (mass %) | N Content (mass %) | Acid Number (mgKOH/g) | Base Number (mgKOH/g) |
|---|---|---|---|---|---|---|---|---|---|
| Base Oil 1 | 20.4 | 4.28 | 116 | — | 0.01> | — | — | — | — |
| Base Oil 2 | 36.8 | 6.52 | 131 | — | 0.01> | — | — | — | — |
| Base Oil 3 | 45.1 | 7.13 | 118 | — | 0.01> | — | — | — | — |
| Base Oil 4 | 90.5 | 10.9 | 105 | — | 0.01> | — | — | — | — |
| Polymer Component | 37500 | 2000 | 300 | 2982 | 0.01> | — | — | — | — |
| Polyacrylate Compound 1 Component (A) | — | 852 | — | 37000 | — | — | — | — | — |
| Polyacrylate Compound 2 Component (A) | — | 490 | — | 30000 | — | — | — | — | — |
| Polyacrylate Compound 3 Component (A) | — | 382 | — | 69000 | — | — | — | — | — |
| Phosphorus Compound 1 Component (B) | — | — | — | — | — | 8.3 | — | 0.01 (I) | — |
| Phosphorus Compound 2 Component (B) | — | — | — | — | — | 7.6 | — | 0.05 (I) | — |
| Phosphorus Compound 3 Component (B) | — | — | — | — | 9.3 | 8.9 | — | 0.01 (PO) | — |
| Phosphate Amine Salt 1 Component (D) | — | — | — | — | — | 9.5 | 4.9 | 259 (I) | — |
| Phosphate Amine Salt 2 Component (D) | — | — | — | — | — | 8.1 | 1.8 | 215 (I) | — |

TABLE 1-continued

| | Kinematic Viscosity at 40° C. ($mm^2/s$) | Kinematic Viscosity at 100° C. ($mm^2/s$) | Viscosity Index | Mass Average Molecular Weight (Mw) | Sulfur Content (mass %) | P Content (mass %) | N Content (mass %) | Acid Number (mgKOH/g) | Base Number (mgKOH/g) |
|---|---|---|---|---|---|---|---|---|---|
| Sulfur Compound 1 Component (E) | — | — | — | — | 20.8 | 9.6 | — | 1.66 (I) | — |
| Sulfur Compound 2 Component (C) | — | — | — | — | 19.8 | 9.3 | — | 167 (PO) | — |
| Oiliness Agent•Dispersant 1 | — | — | — | — | — | — | 1.15 | 2.3 (I) | 19 (PE) |
| Oiliness Agent•Dispersant 2 | — | — | — | — | — | — | 2.3 | 3.7 (PO) | 65 (PE) |
| Oiliness Agent•Dispersant 3 | — | — | — | — | — | — | 2 | 1.0 (PO) | 40 (H) |
| Oiliness Agent•Dispersant 4 | | | | | | | 6.2 | 8.5 (PO) | 81 (H) |
| Metal Deactivator•Anticorrosive 1 | — | — | — | — | — | — | — | 170 (I) | — |
| Metal Deactivator•Anticorrosive 2 | — | — | — | — | — | — | — | 7.5 (I) | — |
| Metal Deactivator•Anticorrosive 3 | — | — | — | — | — | — | 14.6 | 29 (I) | 145 (PE) |
| Hindered Phenolic Antioxidant | — | — | — | — | — | — | — | — | — |
| Amine Antioxidant | — | — | — | — | — | — | 4.8 | — | — |

25

TABLE 2

| | EX. 1 | Ex. 2 | Ex. 3 | Ex. 4 | Ex. 5 | Ex. 6 | Comp. 1 | Comp. 2 |
|---|---|---|---|---|---|---|---|---|
| Base Oil 1 (mass %) | Rest | Rest | Rest | Rest | Rest | Rest | Rest | Rest |
| Base Oil 2 (mass %) | Rest | | | | | | | |
| Base Oil 3 (mass %) | | Rest | | | | | | Rest |
| Base Oil 4 (mass %) | | | Rest | Rest | Rest | Rest | Rest | |
| Polymer Component (mass %) | 0.3 | | | | | | 0.5 | |
| Polyacrylate Compound 1 Component (A) (mass %) | 3 | 3 | 3 | 3 | 3 | 3 | | 3 |
| Polyacrylate Compound 2 Component (A) (mass %) | 10 | 7 | 7 | 7 | 5 | 7 | | 7 |
| Polyacrylate Compound 3 Component (A) (mass %) | 0.5 | 0.5 | | | | 0.5 | | |
| Phosphorus Compound 1 Component (B) (mass %) | 0.8 | 0.8 | 0.8 | | | 0.5 | 0.8 | |
| Phosphorus Compound 2 Component (B) (mass %) | | | | 0.88 | 0.2 | | | 0.4 |
| Phosphorus Compound 3 Component (B) (mass %) | | | | | | 0.05 | | 0.03 |
| Phosphate Amine Salt 1 Component (D) (mass %) | | 0.01 | | | | | | |
| Phosphate Amine Salt 2 Component (D) (mass %) | 0.05 | 0.03 | | | | | | |
| Sulfur Compound 1 Component (E) (mass %) | | | 0.2 | 0.2 | | 0.2 | | 0.2 |
| Sulfur Compound 2 Component (C) (mass %) | | | | | 0.05 | | | |
| Oiliness Agent•Dispersant 1 (mass %) | 0.1 | 0.1 | | | | | 0.1 | |
| Oiliness Agent•Dispersant 2 (mass %) | | | 0.1 | 0.1 | | 0.1 | | |
| Oiliness Agent•Dispersant 3 (mass %) | | | | | | | | 0.1 |
| Oiliness Agent•Dispersant 4 (mass %) | | | | | | 0.03 | | |
| Metal Deactivator•Anticorrosive 1 (mass %) | | | | | | 0.01 | | |
| Metal Deactivator•Anticorrosive 2 (mass %) | 0.1 | 0.1 | 0.1 | 0.1 | 0.1 | | 0.1 | 0.1 |
| Metal Deactivator•Anticorrosive 3 (mass %) | 0.02 | 0.02 | 0.02 | 0.02 | 0.02 | 0.05 | 0.02 | 0.02 |
| Hindered Phenolic Antioxidant (mass %) | 0.6 | 0.6 | 0.6 | 0.6 | 0.6 | 0.4 | 0.6 | 0.6 |
| Amine Antioxidant (mass %) | 0.2 | 0.2 | 0.2 | 0.2 | 0.2 | 0.2 | 0.2 | 0.2 |
| Demulsifier (mass %) | 0.02 | 0.02 | 0.02 | 0.02 | 0.02 | 0.06 | | 0.02 |
| Antifoaming Agent 1 (mass %) | 0.001 | 0.001 | 0.001 | | 0.001 | 0.001 | 0.001 | |
| Antifoaming Agent 2 (mass %) | | | | 0.001 | | | | 0.001 |
| Kinematic Viscosity at 40° C. ($mm^2/s$) | 36.07 | 39.71 | 40.08 | 40.4 | 40.95 | 39.64 | 40.05 | 40.49 |
| Viscosity Index | 190 | 176 | 169 | 169 | 168 | 176 | 127 | 167 |
| Acid Number (mgKOH/g) (indicator method) | 0.07 | 0.12 | 0.04 | 0.04 | 0.07 | 0.04 | 0.05 | 0.03 |
| Rust Inhibition (aritficial seawater) | No rust | No rust | No rust | No rust | No rust | No rust | No rust | No rust |
| FZG Scoring Resistance Test (fail load stage) | 11 | 11 | 11 | 12 | 12< | 11 | 8 | 8 |
| SAE. No. 2(static friction coefficient•1000 cycles) | 0.107 | 0.114 | 0.116 | 0.126 | 0.15 | 0.118 | 0.08 | 0.152 |
| Heat Resistance (sludge amount) (mg/100 mL) | 2 | 3 | 0.8 | 3 | 7 | 4 | 3 | 68 |
| High-pressure Vane Pump Test | | | | | | | | |
| Falling Rate of Kinematic Viscosity at 40° C. | ≤0.1 | ≤0.1 | ≤0.1 | ≤0.1 | ≤0.1 | ≤0.1 | ≤0.1 | ≤0.1 |
| Pump Discharge Flow Rate (L/min) | 41.6 | 41.7 | 42 | 41.8 | 42.1 | 41.6 | 41.2 | — |
| Pump Discharge Flow Rate Ratio (%) | 101.0 | 101.2 | 101.9 | 101.5 | 102.2 | 101.0 | 100.0 | — |
| Overall Pump Efficency (%) | 80.0 | 79.7 | 79.8 | 79.8 | 79.7 | 79.7 | 78.8 | — |

1) Base Oil 1: a paraffinic mineral oil (kinematic viscosity at 40 degrees C.: 20.4 $mm^2/s$, kinematic viscosity at 100 degrees C.: 4.28 $mm^2/s$, viscosity index: 116, sulfur content: less than 0.01 mass %)

2) Base Oil 2: a paraffinic mineral oil (kinematic viscosity at 40 degrees C.: 36.8 $mm^2/s$, kinematic viscosity at 100 degrees C.: 6.52 $mm^2/s$, viscosity index: 131, sulfur content: less than 0.01 mass %)

3) Base Oil 3: a paraffinic mineral oil (kinematic viscosity at 40 degrees C.: 45.1 $mm^2/s$, kinematic viscosity at 100 degrees C.: 7.13 $mm^2/s$, viscosity index: 118, sulfur content: less than 0.01 mass %)

4) Base Oil 4: a paraffinic mineral oil (kinematic viscosity at 40 degrees C.: 90.5 $mm^2/s$, kinematic viscosity at 100 degrees C.: 10.9 $mm^2/s$, viscosity index: 105, sulfur content: less than 0.01 mass %)

5) Polymer Component: ethylene propylene copolymer (kinematic viscosity at 40 degrees C.: 37500 $mm^2/s$, kinematic viscosity at 100 degrees C.: 2000 $mm^2/s$, viscosity index: 300, mass average molecular weight (Mw) (VPO method): 2982, sulfur content: less than 0.01 mass %)

6) Polyacrylate Compound 1 (component (A)): PMA polyacrylate (kinematic viscosity at 100 degrees C.: 852 $mm^2/s$, mass average molecular weight (Mw): 37000)

7) Polyacrylate Compound 2 (component (A)): PMA polyacrylate (kinematic viscosity at 100 degrees C.: 490 $mm^2/s$, mass average molecular weight (Mw): 30000)

8) Polyacrylate Compound 3 (component (A)): PMA polyacrylate (kinematic viscosity at 100 degrees C.: 382 $mm^2/s$, mass average molecular weight (Mw): 69000)

9) Phosphorus Compound 1 (component (B)): tricresyl phosphate

10) Phosphorus Compound 2 (component (B)): mono(di)-t-butyltriphenyl phosphate

11) Phosphorus Compound 3 (component (B)): triphenyl phosphorothioate

12) Phosphate Amine Salt 1 (component (D))

13) Phosphate Amine Salt 2 (component (D))

14) Sulfur Compound 1 (component (E)): dithiophosphoric acid compound

15) Sulfur Compound 2 (component (C)): dithiophosphate compound

16) Oiliness Agent•Dispersant 1: alkyl succinimide (bis-type)

17) Oiliness Agent•Dispersant 2: polybutenyl succinimide, borate

18) Oiliness Agent•Dispersant 3: polyisobutenyl succinimide

19) Oiliness Agent•Dispersant 4: fused amide of an isostearic acid

20) Metal Diactivator•Anticorrosive 1: alkenylsuccinic acid multivalent alcoholester 21) Metal Diactivator•Anticorrosive 2: sorbitan monooleate 22) Metal Diactivato•Anticorrosive 3: N-dialkylaminomethyl benzotriazole 23) Hindered Phenolic Antioxidant: 2,6-di-tert-butyl-P-cresol 24) Amine Antioxidant: monobutylphenylmonooctylphenylamine 25) Demulsifier: polyalkylene glycol demulsifier (block-type PAG)

26) Antifoaming Agent 1: silicone antifoaming agent

27) Antifoaming Agent 2: acrylate antifoaming agent

28) Kinematic Viscosity at 40 Degrees C: Measurement was performed according to JIS K 2283.

29) Kinematic Viscosity at 100 Degrees C: Measurement was performed according to JIS K 2283.

30) Viscosity Index: Measurement was performed according to JIS K 2283.

31) Mass Molecular Weight (Mw): Measurement for the polymer component was performed by VPO method. The mass molecular weight of the polyacrylate compound was a PS equivalent measured by gel permeation chromatography (GPC) method.

32) S Content: Measurement was performed according to JIS K 2541.

33) P Content: A sample oil was diluted in a solvent to measure the P content according to high-frequency inductively coupled plasma optical emission spectrometry (ICP) method.

34) N Content: Measurement was performed according to JIS K 2609.

35) Acid Number/Base Number: Measurement was performed by an indicator method, a potentiometric method, a hydrochloric acid method or a perchloric acid-reverse titration method according to "Determination of Lubricant Neutralization Number" as defined by JIS K 2501. It should be noted that, in Table 1, (I) denotes an indicator method, (PO) denotes a potentiometric method, (H) denotes a hydrochloric acid method, and (PE) denotes a perchloric acid-inverse titration method.

36) Rust Inhibition (artificial seawater): Measurement was performed according to JIS K 2510 (B method: artificial seawater method).

Evaluation Results

As is evident from Tables 1 and 2, the sample oils of Examples 1 to 6, each of which contains all the compositional elements according to the invention, are excellent in wear resistance (FZG scoring resistance, static friction coefficient), heat resistance (the amount of sludge) and a fuel-economy performance (overall pump efficiency).

In contrast, Comparatives 1 and 2, which lack some of the compositional elements according to the invention, are inferior in performance to Examples.

The invention claimed is:

1. A lubricating oil composition, comprising:

a base oil with a kinematic viscosity at 40 degrees C. in a range from 20.4 $mm^2/s$ to 90.5 $mm^2/s$, a viscosity index of 100 or more and a sulfur content of less than 0.03 mass %;

a component (A) being at least one polyacrylate compound with a mass average molecular weight in a range from 30,000 to 37,000 which is a homopolymer;

a component (B) selected from the group consisting of tricresyl phosphate and mono(di)-t-butyltriphenyl phosphate;

a component (E) consisting of ethyl-3-[{bis(1-methylethoxy)phosphino thioyl}thio]propionate; and a boron-modified polybutenyl succinimide, wherein:

a content of the component (A) is from 8 mass % to 10 mass % of a total amount of the lubricating oil composition;

a content of the component (B) is from 0.55 mass % to 1.0 mass % of the total amount of the lubricating oil composition;

a content of the component (E) is about 0.2 mass %;

a content of the boron-modified polybutenyl succinimide is about 0.1 mass %;

a viscosity index of the composition is 160 or more;

the base oil is a paraffinic mineral oil; and the lubricating oil composition does not contain a dispersed polyacrylate compound.

2. A hydraulic oil, comprising the lubricating oil composition according to claim 1.

3. The lubricating oil composition according to claim 1, wherein the lubricating oil composition exhibits the following:

a wear resistance measured according to the FZG scoring resistance test according to ISO 14635-1 of from 11 to 12;

a static friction coefficient at 1000 cycles measured by SAE no. 2 friction test according to JCMAS P047 of from 0.107 to 0.15; and a heat resistance as reflected in an amount of sludge after an oxidation test according to JISK 2514-1996 of from 0.8 to 7 mg/100 mL.

4. The lubricating oil composition according to claim 1, wherein the component (B) is the mono(di)-t-butyl triphenyl phosphate.

5. The lubricating oil composition according to claim 1, wherein the content of the component (B) ranges from 0.55 mass % to 0.88 mass % based on the total amount of the lubricating oil composition.

6. The lubricating oil composition according to claim 1, wherein the component (B) is the tricresyl phosphate.

7. The lubricating oil composition according to claim 1, wherein the base oil has a kinematic viscosity at 100 degrees C. ranging from 6.52 $mm^2/s$ to 10.9 $mm^2/s$.

8. The lubricating oil composition according to claim 1, wherein the base oil comprises a plurality of paraffinic mineral oils each having the kinematic viscosity at 40 degrees C. in a range from 20.4 $mm^2/s$ to 90.5 $mm^2/s$.

* * * * *